US011136749B2

(12) United States Patent
Shen et al.

(10) Patent No.: US 11,136,749 B2
(45) Date of Patent: Oct. 5, 2021

(54) SIMPLE INSTALLATION MODULE FOR INSTALLATION ON COUNTERTOP

(71) Applicants: Jianxiong Shen, Fujian (CN); Zhen Li, Fujian (CN); Haitao Lu, Fujian (CN); Ximin Chen, Fujian (CN)

(72) Inventors: Jianxiong Shen, Fujian (CN); Zhen Li, Fujian (CN); Haitao Lu, Fujian (CN); Ximin Chen, Fujian (CN)

(73) Assignee: Xiamen EASO Co., Ltd., Xiamen (CN)

( * ) Notice: Subject to any disclaimer, the term of this patent is extended or adjusted under 35 U.S.C. 154(b) by 0 days.

(21) Appl. No.: 16/988,740

(22) Filed: Aug. 10, 2020

(65) Prior Publication Data

US 2021/0095446 A1 Apr. 1, 2021

(30) Foreign Application Priority Data

Apr. 24, 2020 (CN) ..... 202010334470.7

(51) Int. Cl.
*E03C 1/04* (2006.01)

(52) U.S. Cl.
CPC .... *E03C 1/0402* (2013.01); *E03C 2001/0416* (2013.01)

(58) Field of Classification Search
CPC ..... E03C 1/0401; E03C 1/0402; E03C 2001/0416
See application file for complete search history.

(56) References Cited

U.S. PATENT DOCUMENTS 6,301,728 B1 * 10/2001 Pilatowicz ..... E03C 1/0401 137/360
6,334,226 B1 * 1/2002 Tokunaga ..... E03C 1/0401 4/675
10,329,747 B2 * 6/2019 Lu ..... E03C 1/0402
10,683,646 B2 * 6/2020 Pei ..... E03C 1/0401

* cited by examiner

*Primary Examiner* — Erin Deery

(57) ABSTRACT

A simple installation module for installation on a countertop includes a fixing seat to be fixed in a mounting hole in a countertop, a connecting rod mechanism, and a screw rod. At least one guide rod is connected to the lower portion of the fixing seat, at least one guide part to be matched with the guide rod is arranged on the connecting rod mechanism, and the screw rod is matched and connected with the connecting rod mechanism.

8 Claims, 12 Drawing Sheets

SIMPLE INSTALLATION MODULE FOR INSTALLATION ON COUNTERTOP

BACKGROUND OF THE INVENTION

1. Technical Field

The invention relates to a simple installation module for installation on a countertop. The simple installation module is suitable for installation of faucets, such as pure water faucets.

2. Description of Related Art

At present, common faucets are typically installed against walls, and due to the fact that there is little space under countertops, installation is inconvenient. Most faucets on the current market, particularly pure water faucets and kitchen faucets, are installed under the countertops and have the following installation disadvantages: first, the environment under the countertops is dark, installation personnel has to climbs into the space under the countertops, the installation steps are complicated, and the installation difficulty is increased to a large extent; second, because the space under the countertops is narrow and the vision and operation space are hindered by pipes and circuits under the countertops, the installation tools such as spanners cannot be used easily; third, the faucets are inconvenient to disassemble, and on account of a large number of pipes under the countertops, installation personnel has to bend down to disassemble the faucets, which consumes much time and strength. Although there have already been some simple installation structures in the prior art, all these structures are poor in stability and inconvenient to operate.

BRIEF SUMMARY OF THE INVENTION

To solve the aforesaid technical problems, the objective of the invention is to provide a simple installation module for installation on a countertop.

The invention is implemented through the following technical solution:

A simple installation module for installation on a countertop comprises a fixing seat, a connecting rod mechanism and a screw rod, wherein the fixing seat is to be fixed in a mounting hole in a countertop, at least one guide rod is connected to the lower portion of the fixing seat, at least one guide part to be matched with the guide rod is arranged on the connecting rod mechanism, and the screw rod is matched and connected with the connecting rod mechanism.

In one embodiment of the invention, the connecting rod mechanism comprises an upper connector, and a lower connector connected with the upper connector, wherein the lower connector is able to move close to or away from the upper connector, the upper connector is connected with the lower connector through a connecting rod assembly, and a limit block is arranged between the upper connector and the lower connector.

In one embodiment of the invention, the connecting rod assembly comprises a first connecting rod and a second connecting rod, wherein two sides of the upper connector are hinged to one end of the first connecting rod, two sides of the lower connector are hinged to one end of the second connecting rod, the other end of the first connecting rod is hinged to the other end of the second connecting rod, a first through hole allowing the screw rod to be inserted therein is formed in the upper connector, and the lower connector is connected with the screw rod in a threaded manner.

In one embodiment of the invention, slopes matched with the second connecting rod are arranged on the lower connector to ensure that an angle between the upper connector and the lower connector is not smaller than 90°.

In one embodiment of the invention, a groove is formed in the lower connector, and a nut matched with the screw rod is arranged in the groove.

In one embodiment of the invention, a protrusion and a rib matched with the peripheral wall of the nut are arranged on the inner wall of the groove.

In one embodiment of the invention, a second through hole allowing the screw rod to be inserted therein is formed in the lower connector and is correspondingly matched with the groove.

In one embodiment of the invention, a reset device is arranged between the upper connector and the lower connector.

In one embodiment of the invention, the fixing seat comprises a body, wherein a convex ring matched with the mounting hole is arranged at the lower end of the body, a flange to be supported on the countertop is arranged on the body above the convex ring, a hole is formed in the middle of the body, a connecting ring fixedly connected with the body is arranged in the hole, at least one guide rod is arranged below the connecting ring, a third through hole allowing the screw rod to be inserted therein is formed in the connecting ring, and the screw rod is erected on the third through hole.

In one embodiment of the invention, a connecting piece matched with the side wall of the body is arranged on the connecting ring, a first connecting through hole is formed in the connecting piece, and a second connecting through hole matched with the first connecting through hole is formed in the side wall of the body.

The simple installation module for installation on the countertop of the invention has the following beneficial effects: the section of the connecting rod mechanism in the horizontal direction is arc, so that the connecting rod mechanism can be disposed in the mounting hole more easily; and the eccentric distance is smaller, so that an upward turning force applied to the connecting rod mechanism is smaller when the connecting rod mechanism is locked. The slopes are arranged on the lower connector, so that the connecting rods of the connecting rod mechanism can only stretch outwards and cannot retreat inwards to guarantee normal use of the structure. The guide part of the lower connector is matched with the guide rod to fulfill a limit effect, so that the connecting rod mechanism is not prone to turning in use (relative movement between the upper connector and the lower connector), and the structural stability is guaranteed. The support column between the upper connector and the lower connector can fulfill a limiting and supporting effect after the bolt is screwed in place, so that the lower connector where the nut is installed will not fracture when the bolt is excessively locked. Most components are injection-molded parts, so that the overall cost is lower on the premise that all functions are realized.

BRIEF DESCRIPTION OF THE SEVERAL VIEWS OF THE DRAWINGS

To explain the technical solutions of the invention more clearly, a brief description of the accompanying drawings required for illustrating the embodiments of the invention or the prior art is provided below. Obviously, the accompanying drawings in the following description are merely for illustrating some embodiments of the invention, and those ordinarily skilled in the art can obtain other drawings according to the following ones without creative labor.

DETAILED DESCRIPTION OF THE INVENTION

The technical solutions of the embodiments of the invention will be clearly and completely described below in conjunction with the accompanying drawings of the embodiments. Clearly, the embodiments in the following description are merely illustrative ones, and are not all possible ones of the invention. All other embodiments obtained by those skilled in the art on the basis of the following ones without creative labor should also fall within the protection scope of the invention.

"One embodiment" or "embodiments" referred to herein may include specific features, structures or properties in at least one implementation of the invention. It should be noted that the terms such as "upper", "lower", "top" and "bottom" involved in the description of the invention are used to indicate directional or positional relations on the basis of the accompanying drawings to facilitate and simplify the description of the invention, do not indicate or imply that the devices or elements referred to must have specific directions or must be configured and operated in specific directions, and thus should not be construed as limitations of the invention. In addition, the terms "first" and "second" are only used for the purpose of description, and should not be interpreted as indications or implications of relevant importance or the quantities of technical features referred to. Hence, when a feature is defined by "first" or "second", one or more of this feature may be clearly or implicitly included. Moreover, the terms such as "first" and "second" are also used to distinguish similar objects, and do not indicate a specific sequence or a precedence order. It should be understood that such data can be exchanged in appropriate cases to ensure that the embodiments of the invention can be implemented in other orders except those illustrated or described herein.

Figure 1:
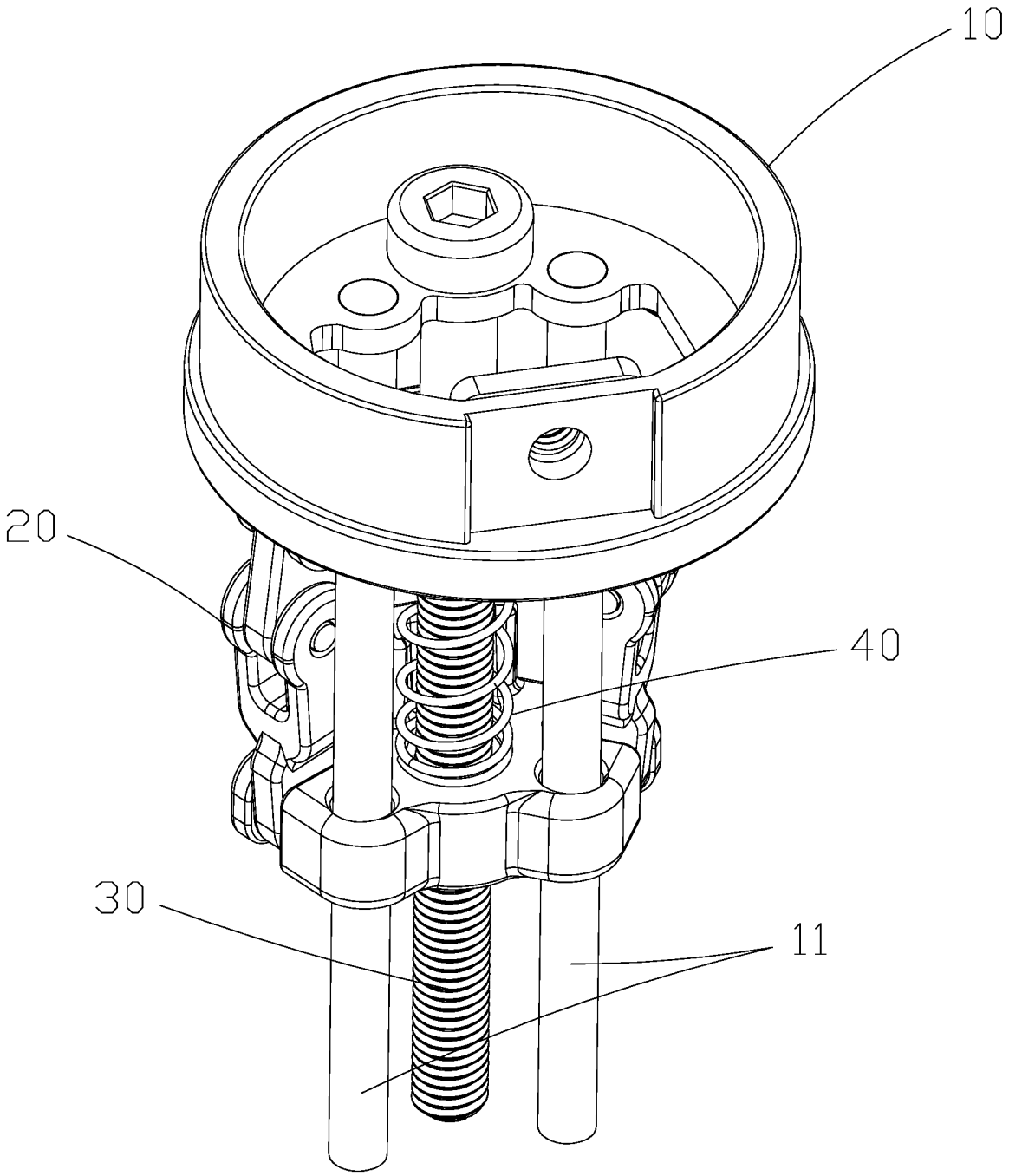
FIG. 1 is a first perspective view of the invention.
Figure 2:
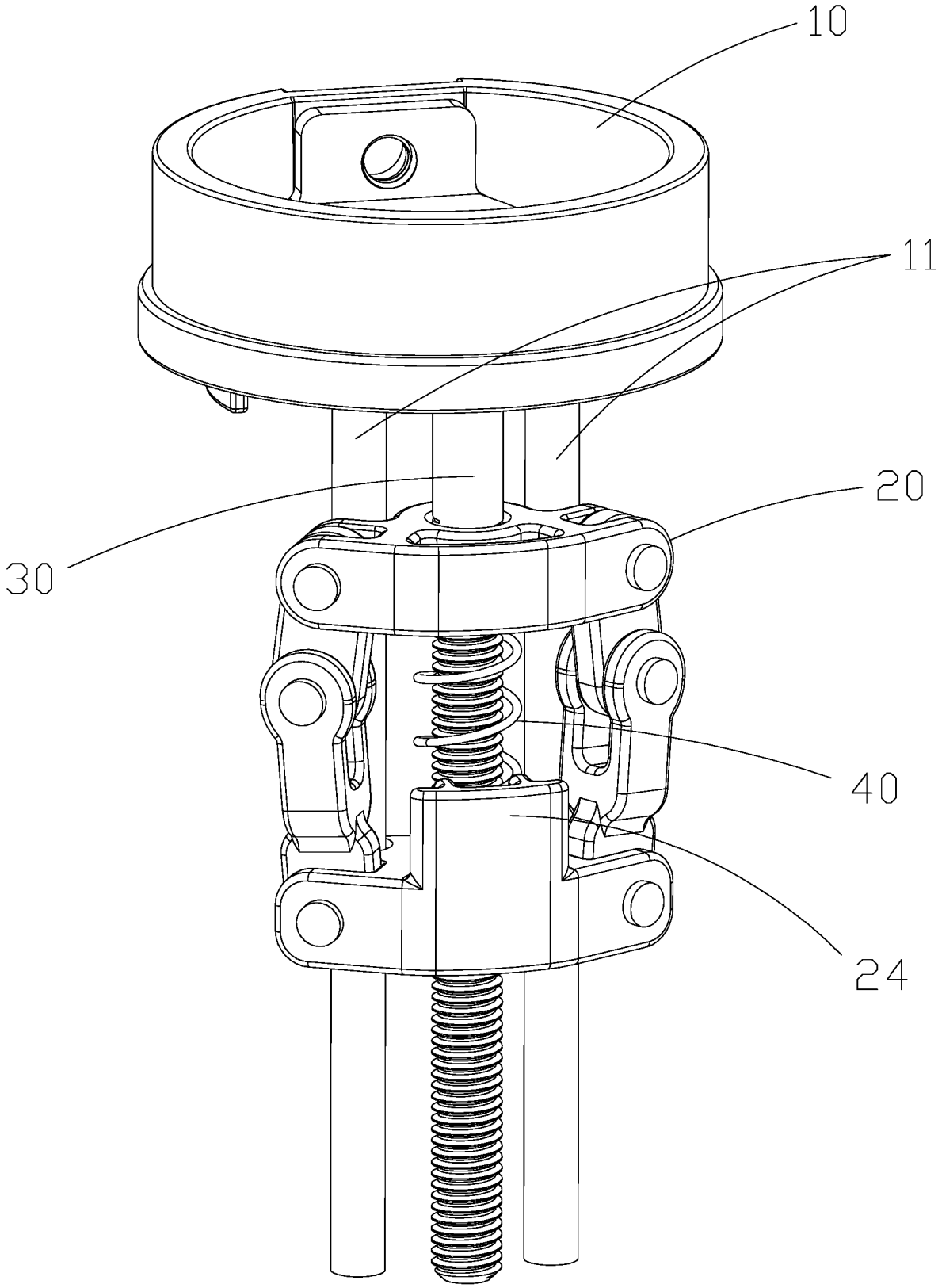
FIG. 2 is a second perspective view of the invention.
Figure 3:
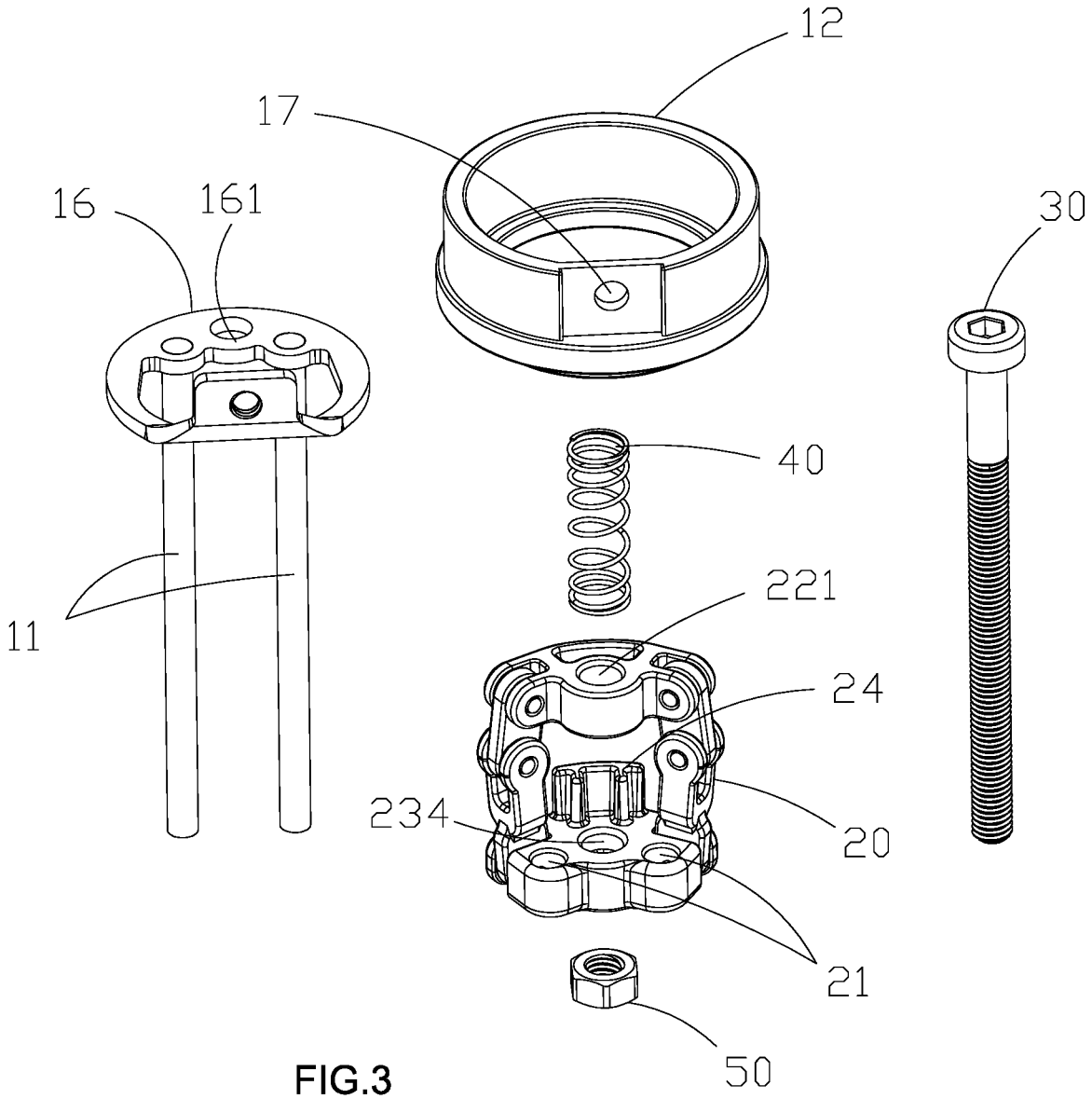
FIG. 3 is a first exploded view of the invention.
Figure 4:
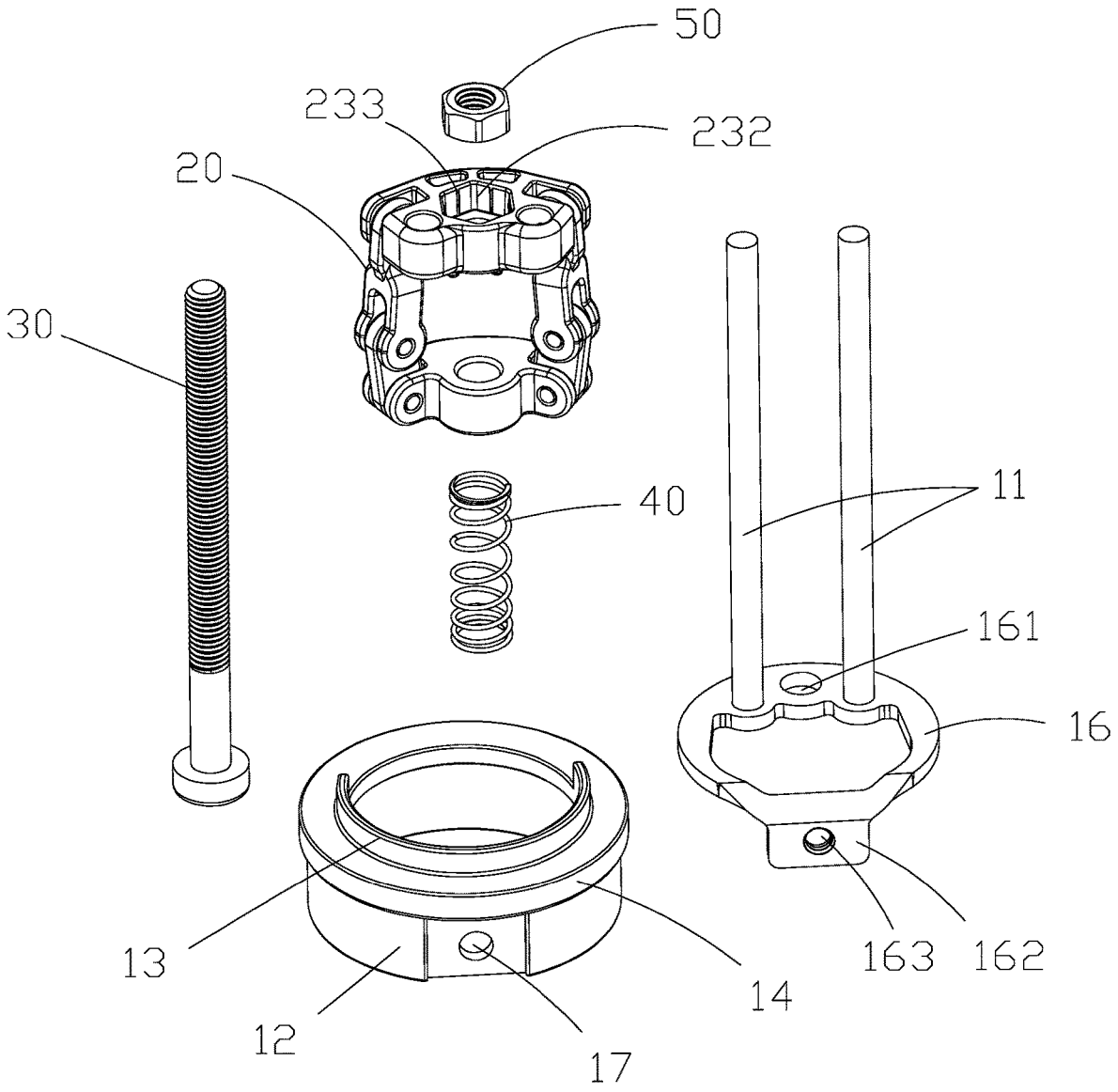
FIG. 4 is a second exploded view of the invention.
Figure 5:
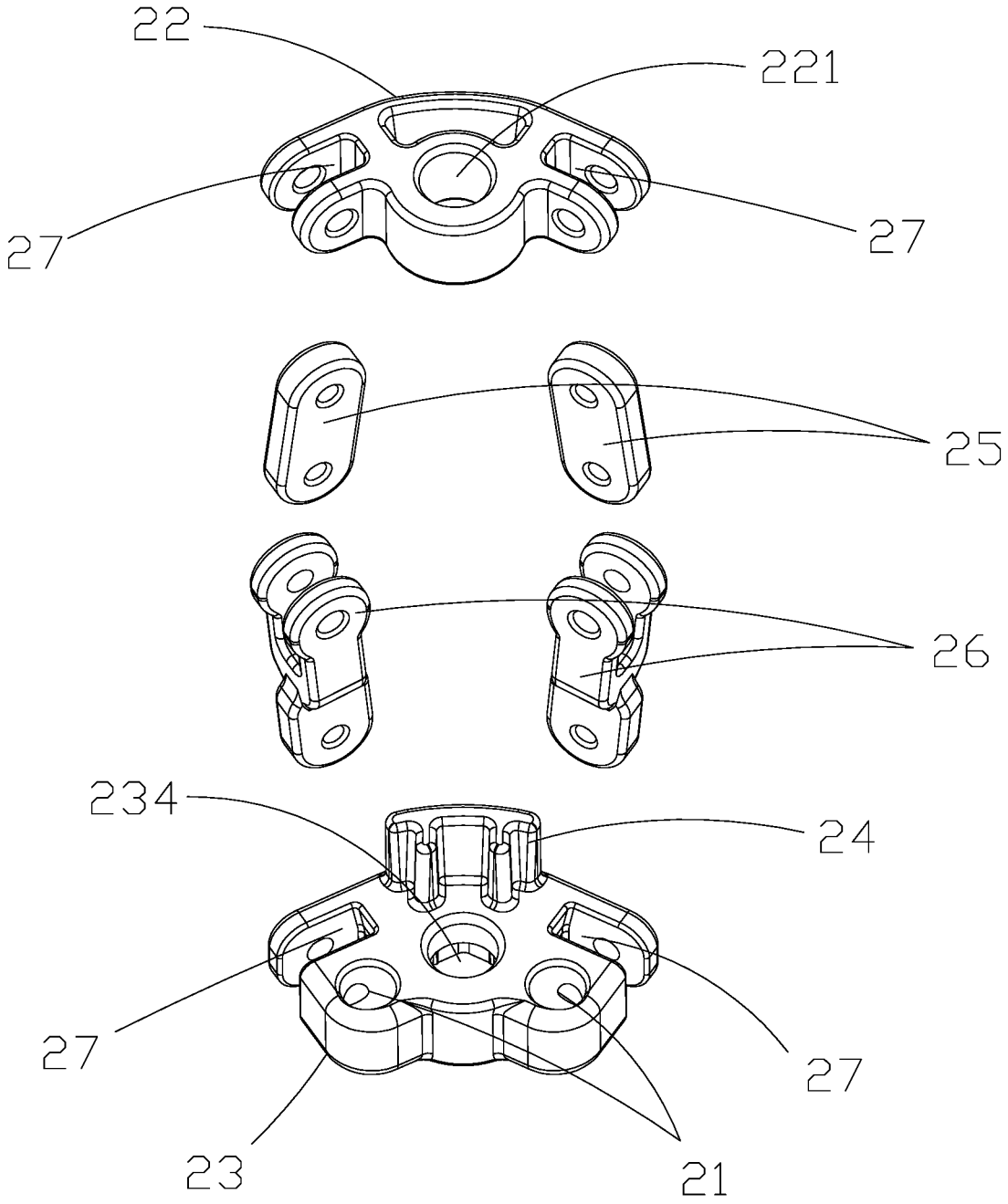
FIG. 5 is a first schematic diagram of a connecting rod mechanism of the invention.
Figure 6:
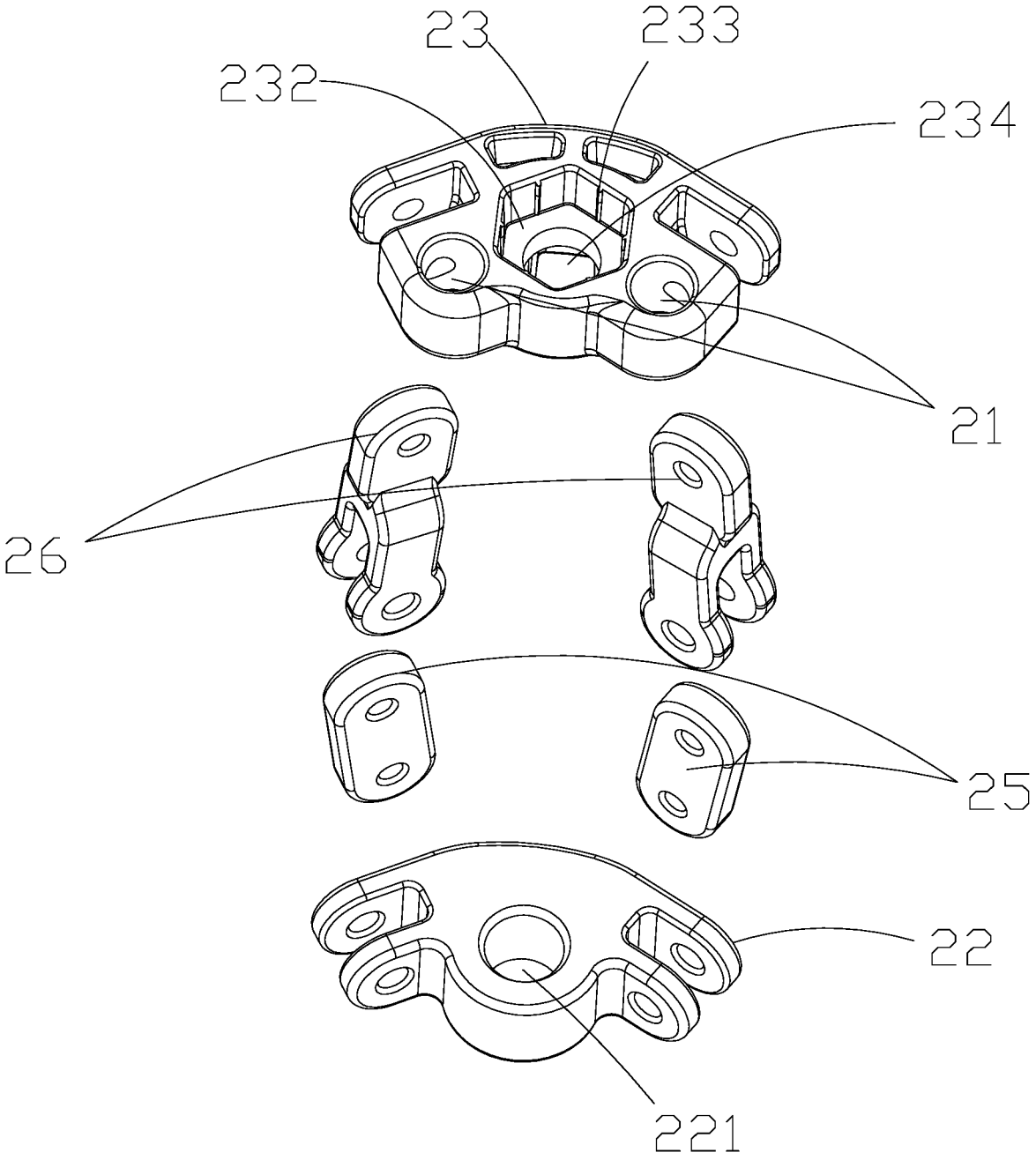
FIG. 6 is a second schematic diagram of the connecting rod mechanism of the invention.

Referring to FIGS. 1 to 9, a simple installation module for installation on a countertop of the invention comprises a fixing seat 10, a connecting rod mechanism 20, and a screw rod 30, wherein the fixing seat 10 is to be fixed in a mounting hole 110 in a countertop 100, and in the specific using process, the fixing seat may be directly connected to a body of a faucet to realize quick installation of the faucet; at least one guide rod 11 is connected to the lower portion of the fixing seat, and to ensure that the simple installation module of the invention has better structural stability, two guide rods are symmetrically arranged with respect to the axis of the screw rod, specifically as shown in the figures; at least one guide part 21 to be matched with the guide rod is arranged on the connecting rod mechanism, and a pair of guide parts is arranged corresponding to the pair of guide rods mentioned above; in a preferred embodiment, the guide parts may be guide holes 20; or as shown in FIG. 3, the guide parts may be U-shaped/V-shaped slots that can prevent the connecting rod mechanism from turning when the state of the connecting rod mechanism is changed, so as to improve the structural stability; and the screw rod is matched and connected with the connecting rod mechanism and is mainly used to drive the connecting rod mechanism to change its state. Specific details will be provided below with reference to the accompanying drawings.

The connecting rod mechanism comprises an upper connector 22, and a lower connector 23 connected with the upper connector 22. More specifically, a reset device 40 is arranged between the upper connector and the lower connector and is an elastic piece or other devices. In the embodiment illustrated in the figures, the reset device is a reset spring. Preferably, the reset spring is disposed around the screw rod; in a normal state or a non-stress state, the upper connector and the lower connector are stretched by the reset spring to be kept spaced apart from each other (that is, the distance between the upper connector and the lower connector is maximized), and the lower connector can move close to or away from the upper connector. In the using process of the simple installation module of the invention, when the position of the upper connector cannot be changed anymore, the screw rod will continue to rotate to enable the lower connector to move towards the upper connector, and at this moment, the reset device is compressed. The upper connector and the lower connector are connected by means of a connecting rod assembly, and the connecting rod assembly may be formed by connecting at least two connecting rods and will be further expounded below. A limit block 24 is arranged between the upper connector and the lower connector and is disposed below the upper connector or above the lower connector, so that when the limit block contacts with the upper connector and the lower connector, that is to say, when the distance between the upper connector and the lower connector is minimized, the fixing seat will be fixedly installed on the countertop.

Figure 7:
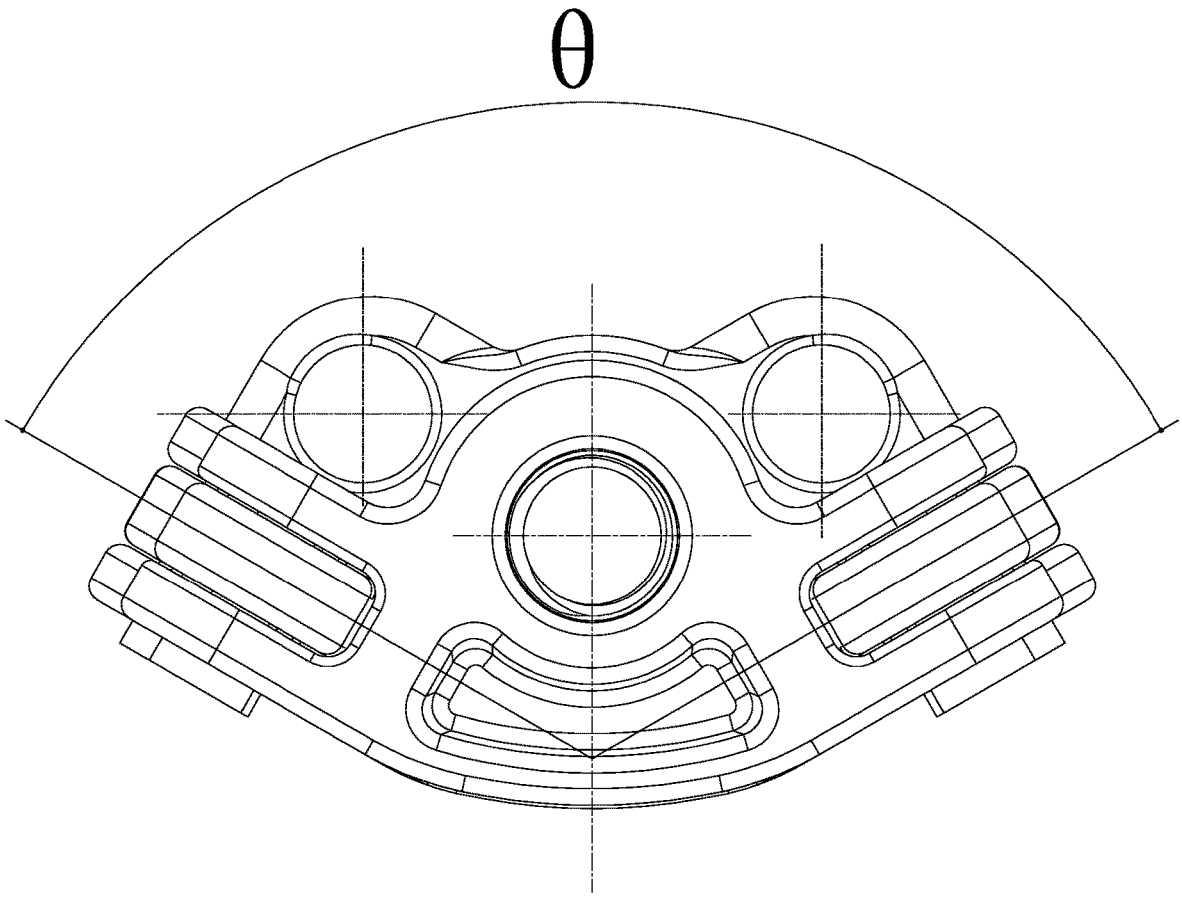
FIG. 7 is a third schematic diagram of the connecting rod mechanism of the invention.

In a preferred embodiment, the connecting rod assembly comprises a first pair of connecting rods 25 and a second pair of connecting rods 26 in which first ends of each rod of the first pair of connecting rods 25 are hingedly connected to the upper connector 22 on opposite sides, first ends of each rod of the second pair of connecting rods 26 are hingedly connected to the lower connector 23 on opposite sides, and respective second ends of each rod of the first pair of connecting rods 25 are hingedly connected to respective second ends of each rod of the second pair of connecting rods 26. More specifically, either the first connecting rod or the second connecting rod is in a Y shape. As illustrated in the figures, the second connecting rod is in a Y shape, and the other end of the second connecting rod is formed with an opening hinged to the other end of the first connecting rod, and both the upper connector and the lower connector are in an arc shape. In use, a slot 27 is formed in each of the two sides of the upper connector, a slot 27 is formed in each of the two sides of the lower connector, and one end of the first connecting rod and one end of the second connecting rod are disposed in the slots 27 to be separately hinged to the upper connector and the lower connector; an angle θ is formed between the two slots in the upper connector and between the two slots in the lower connector on the horizontal plane, and preferably, the angle θ is an obtuse angle. As shown in FIG. 7 specifically, the upper connector has a first through hole 221 allowing the screw rod to be inserted therein. In one embodiment, the screw rod cannot directly drive the upper connector to move; and when the upper connector is blocked, the lower connector is connected to the screw rod in a threaded manner and will move with respect to the upper connector under the effect of the screw rod to fix the fixing seat on the countertop.

Figure 8:
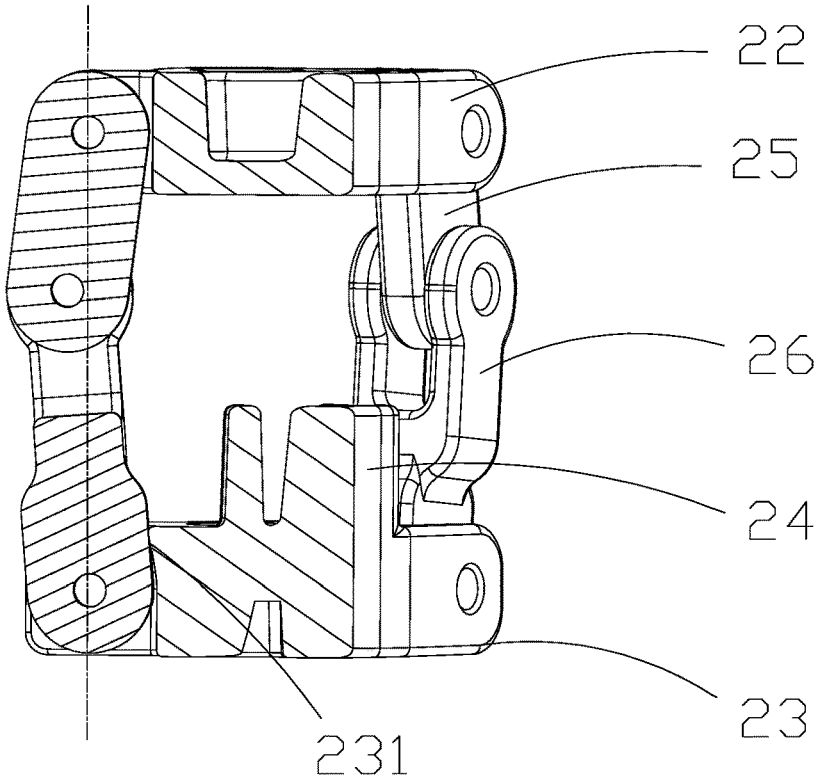
FIG. 8 is a schematic diagram of the connecting rod mechanism in a first state of the invention.
Figure 9:
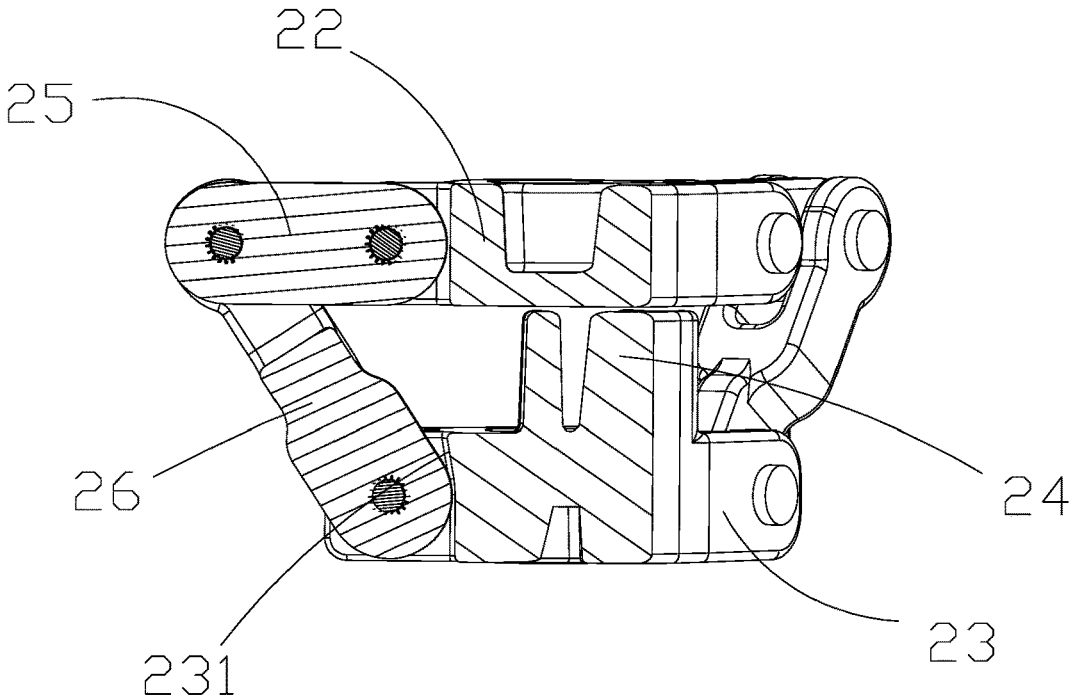
FIG. 9 is a schematic diagram of the connecting rod mechanism in a second state of the invention.
Figure 10:
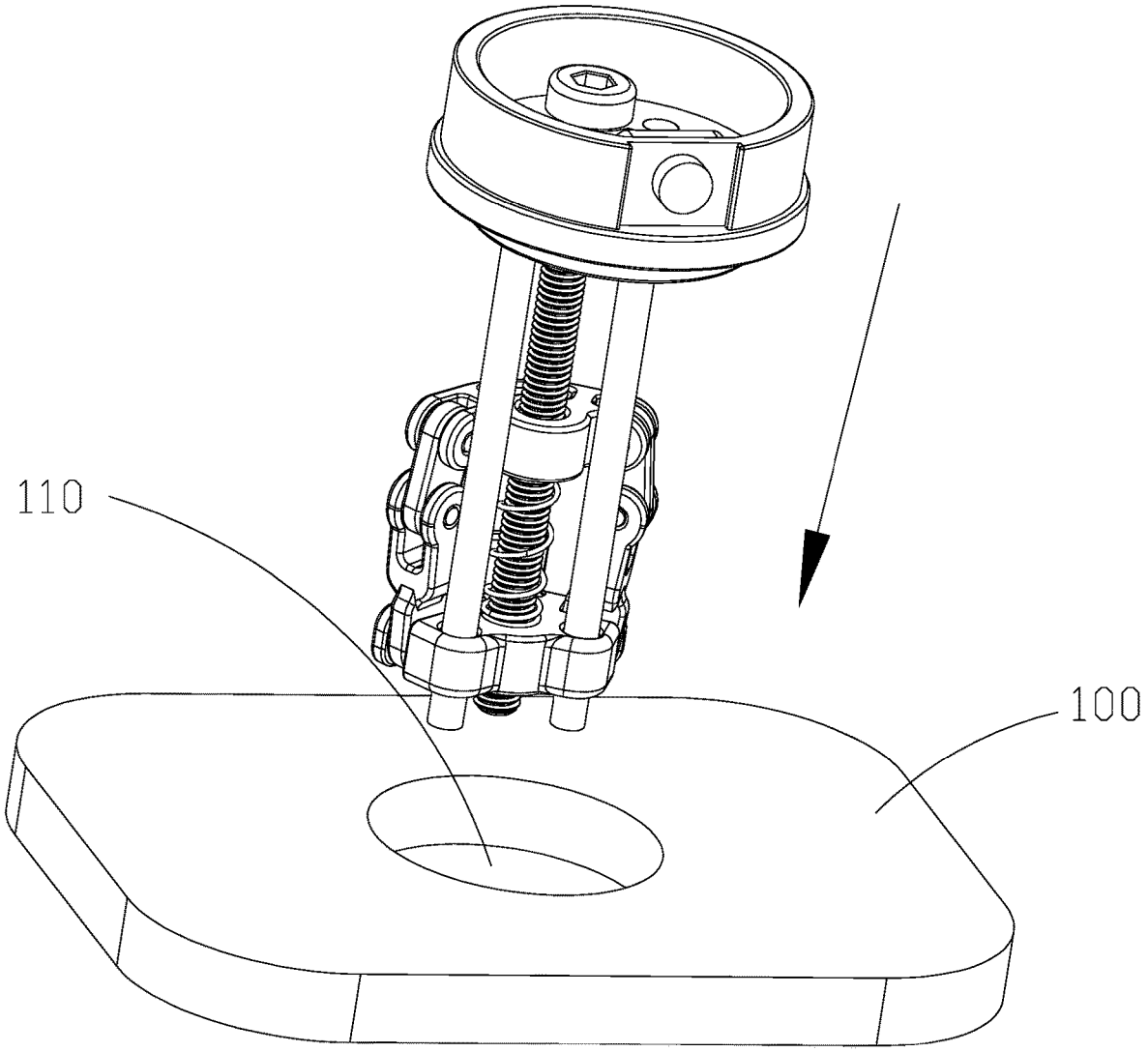
FIG. 10 is a schematic diagram of a first installation state of the invention.
Figure 11:
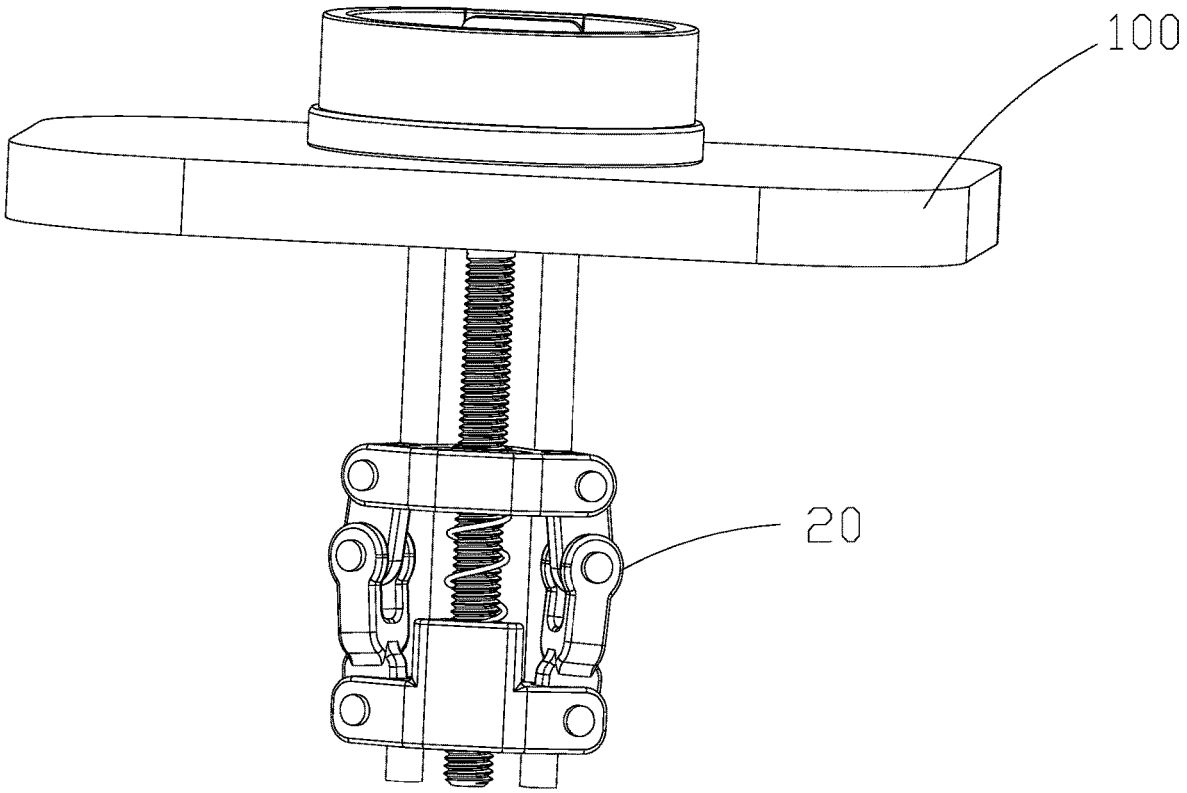
FIG. 11 is a schematic diagram of a second installation state of the invention.
Figure 12:
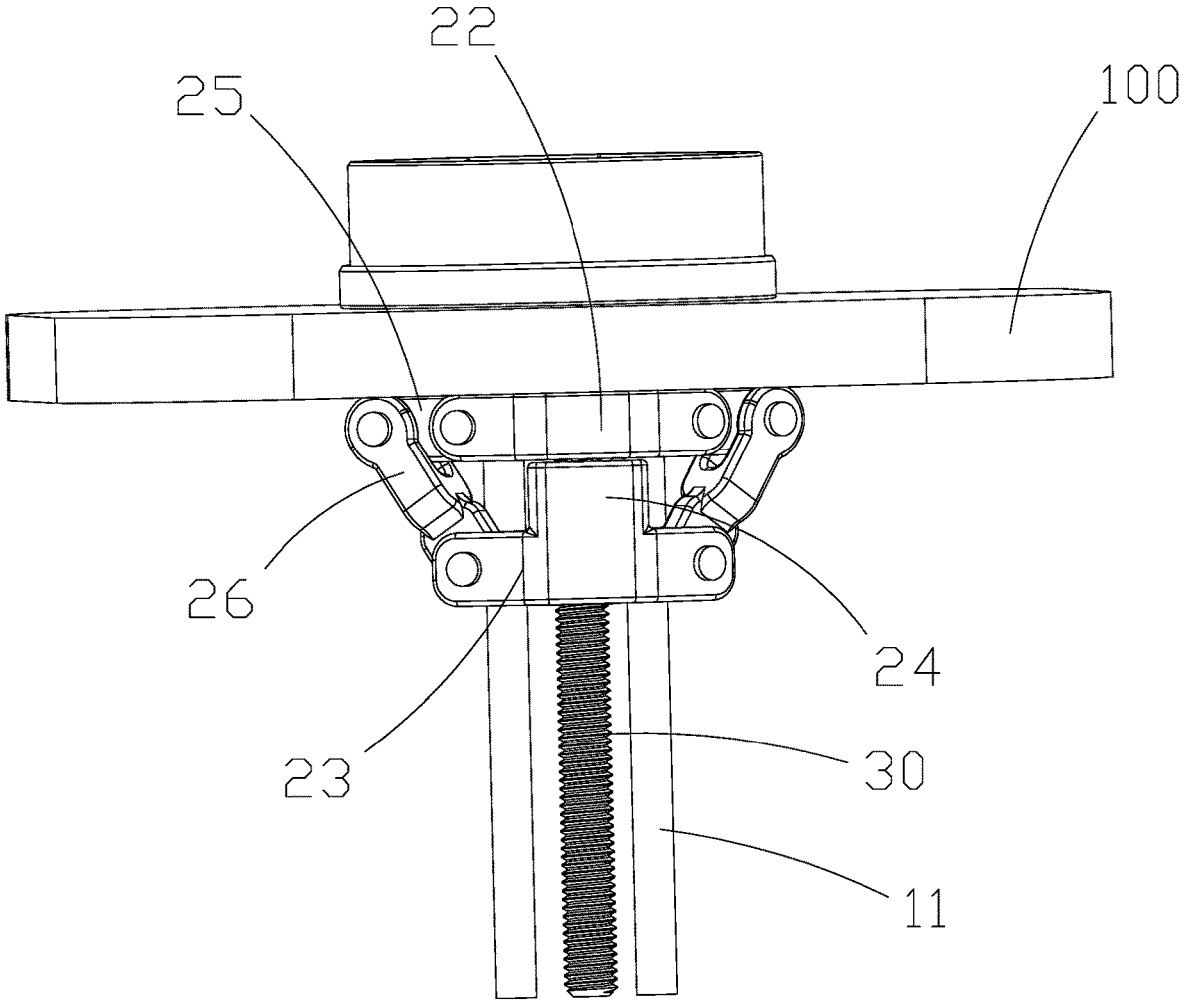
FIG. 12 is a first schematic diagram of a third installation state of the invention.
Figure 13:
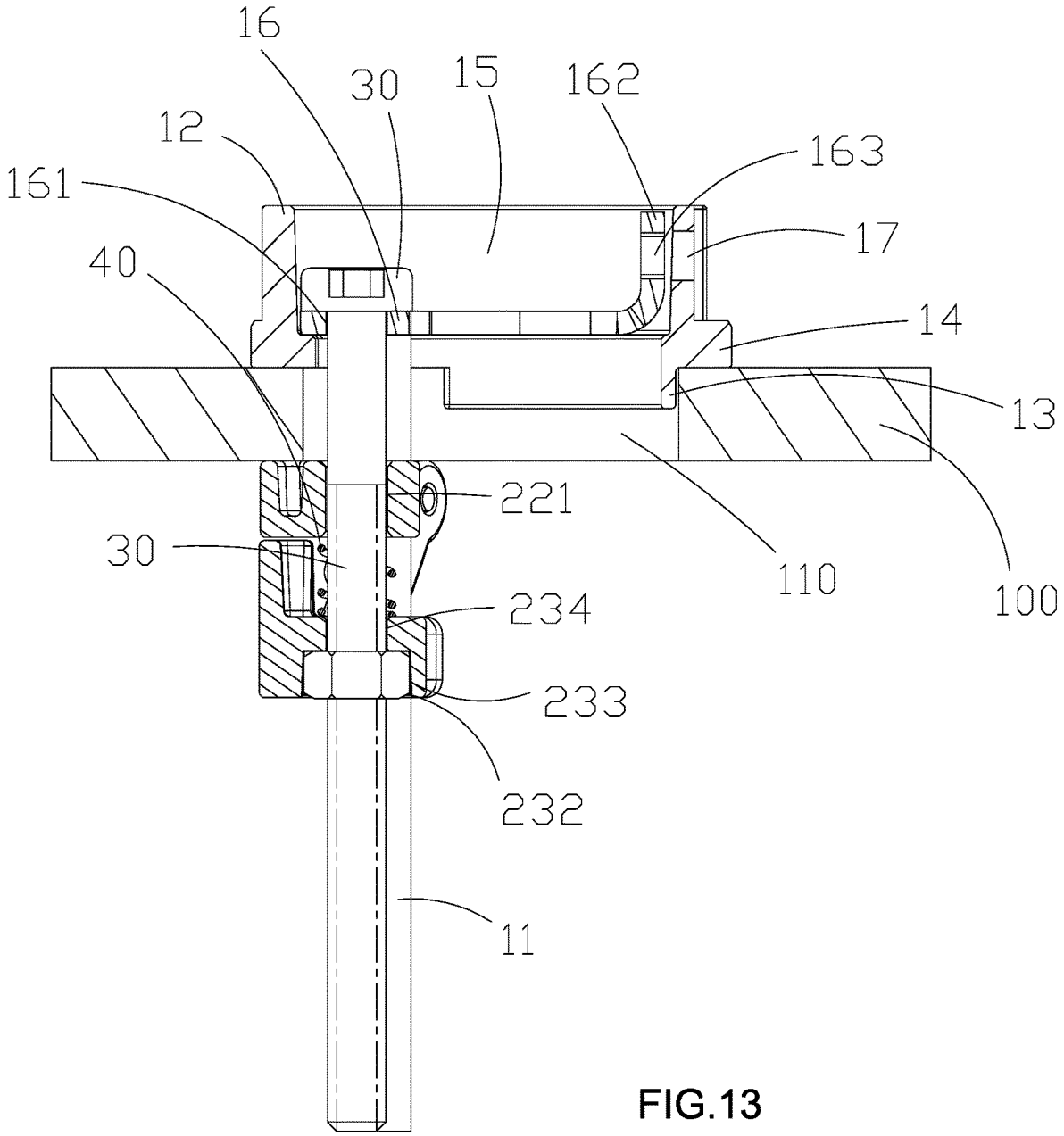
FIG. 13 is a second schematic diagram of the third installation state of the invention.

To ensure that the connecting rod assembly can stretch outwards smoothly, two slopes 231, each slope 231 matching a respective rod of the second pair of connecting rods 26, are arranged on the lower connector to make the angle between the upper connector and the lower connector not smaller than 90°. Specifically, as shown in FIG. 8 and FIG. 9, protrusions are arranged on the side walls of the slots of the lower connector to form the slopes, so that when the upper connector and the lower connector move close to each other, the connecting rod assembly can stretch outwards. In a preferred embodiment, hinge points A on identical sides of the upper connector and the lower connector are located on the same vertical line, and hinge points B of the first connecting rod and the second connecting rod are not located on this vertical line.

To better protect the lower connector, a groove 232 is formed in the lower connector, and a nut 50 matched with the screw rod is arranged in the groove. A protrusion 233 matched with the peripheral wall of the nut are arranged on the inner wall of the groove, the nut can be clamped in the groove by the rib, and a gap is reserved between the peripheral wall of the nut and the inner wall of the groove, so that the nut can be disassembled easily. A second through hole 234 allowing the screw rod to be inserted therein is formed in the lower connector and is correspondingly matched with the groove, and the diameter of the second through hole and the diameter of the first through hole may be both greater than the outer diameter of the screw rod, that is, the first through hole and the second through hole are not directly in threaded fit with the screw rod in use.

More specifically, the fixing seat comprises a body 12, wherein an arc 13 matched with the mounting hole is arranged at the lower end of the body and is matched with the circumferential wall of the mounting hole to prevent the fixing seat from shaking in the axial direction. Preferably, the arc 13 may be an arc part, and a flange 14 to be supported on the countertop is arranged on the body above the arc 13. In the invention, the fixing seat is clamped on the countertop mainly through the arc 13 and the upper connector, and a hole 15 allowing a pipe or other parts of the faucet to penetrate through is formed in the middle of the body, a connecting ring 16 fixedly connected with the body is arranged in the hole, the middle of the connecting ring is hollowed out to allow the pipe or other parts of the faucet to penetrate through, and at least one guide rod is arranged below the connecting ring. To realize better stability, two guide rods are arranged below the connecting ring. More preferably, the guide parts are only arranged on the lower connector and are symmetrically disposed with respect to the axis of the screw rod. A third through hole 161 allowing the screw rod to be inserted therein is formed in the connecting ring, the screw rod is inserted in the third through hole with the head in contact and fit with the connecting ring on the circumferential wall of the third through hole, so that screw rod will not fall. A connecting piece 162 matched with the side wall of the body is arranged on the connecting ring, a first connecting through hole 163 is formed in the connecting piece, a second connecting through hole 17 matched with the first connecting through hole is formed in the side wall of the body, and the connecting ring is matched and connected with the body through a connecting bolt, the first connecting through hole and the second connecting through hole.

More specifically, the fixing seat is matched with the guide parts of the connecting rod mechanism through the guide rods to guide the connecting rod mechanism and to prevent the connecting rod mechanism from turning; after being tightened, the limit block between the lower connector and the upper connector fulfills a limiting and supporting effect to ensure that hinge portions of the connecting rod mechanism will not fracture when the bolt is excessively locked (in one embodiment, the hinge portions are connected through a short pin); and the camber angles (slopes) designed on the lower connector ensure that the connecting rod assembly can only stretch outwards and cannot retreat inwards when the connecting rod mechanism is locked. The entire connecting rod mechanism is in an arc shape in the horizontal direction and thus can be disposed in the mounting hole more easily. The eccentric distance is smaller, so that an upward turning force applied to the connecting rod mechanism is smaller when the connecting rod mechanism is locked. The connecting rod mechanism is stretched by an elastic force from the reset device to be easily disposed in the mounting hole. When disassembled, the connecting rod mechanism is unlocked to allow the whole module to be taken out of the mounting hole. The nut is in interference fit with the groove and thus can be changed easily. Compared with threads directly machined on the connecting rod mechanism, the nut is less likely to be damaged and has a better pre-locking hand feeling.

Referring to FIGS. 10 to 13, the installation process of the invention is as follows: first of all, the entire module is placed in the mounting hole (the module can be obliquely inserted into the mounting hole more easily), and at this moment, the flange is supported on the upper end face of the countertop; the locking bolt is rotated to drive the entire connecting rod mechanism to move upwards until the upper end of the connecting rod mechanism (namely, the upper end of the upper connector) touches the lower end face of the countertop, the bolt is further rotated to stress the connecting rod assembly to be stretch outwards until the limit block is in contact and fit with the upper connector and the lower connector, and at this moment, the entire module is installed and fixed on the countertop. Preferably, in this state, the first connecting rod and the upper connector are horizontal and are in contact and fit with the lower end face of the countertop. These operations can be performed reversely to complete the disassembly process of the invention.

The preferred embodiments of the invention are illustrated and described above. It should be understood that the embodiments in this specification are not intended to limit the invention or exclude other embodiments, the invention can also be implemented in various other combinations, modifications and environments, and the transformations can be made within the concept scope of the invention on the basis of the above enlightenments, or techniques or knowledge in relating fields. All transformations and variations made by those skilled in the art without departing from the spirit and scope of the invention should fall within the protection scope defined by the appended claims.

What is claimed is:

1. An installation module for installation on a countertop, comprising:

a fixing seat configured to fasten in a mounting hole of the countertop;

a connecting rod mechanism;

a screw rod matching the connecting rod mechanism and connected thereto;

at least one guide rod connected to a lower portion of the fixing seat; and at least one guide part matching the at least one guide rod and arranged on the connecting rod mechanism;

wherein the connecting rod mechanism comprises an upper connector, a lower connector, and a limit block arranged between the upper connector and the lower connector;

wherein the lower connector is configured to move toward or away from the upper connector;

wherein the upper connector is connected to the lower connector through a connecting rod assembly;

wherein the connecting rod assembly comprises a first pair of connecting rods, a second pair of connecting rods, and a first through hole in the upper connector for allowing the screw rod to insert therein;

wherein the screw rod is threadedly connected to the lower connector; and wherein first ends of each rod of the first pair of connecting rods are hingedly connected to the upper connector on opposite sides, first ends of each rod of the second pair of connecting rods are hingedly connected to the lower connector on opposite sides, and respective second ends of each rod of the first pair of connecting rods are hingedly connected to respective second ends of each rod of the second pair of connecting rods.

2. The installation module for installation on the countertop of claim 1, wherein the lower connector includes two slopes, each slope matching a respective rod of the second pair of connecting rods to ensure that an angle between the upper connector and the lower connector is not less than 90 degrees.

3. The installation module for installation on the countertop of claim 2, further comprising a groove in the lower connector, and a nut matching the screw rod and arranged in the groove.

4. The installation module for installation on the countertop of claim 3, further comprising a protrusion matching a peripheral wall of the nut and arranged on an inner wall of the groove.

5. The installation module for installation on the countertop of claim 4, further comprising a second through hole in the lower connector for allowing the screw rod to insert therein, wherein the second through hole matches the groove.

6. The installation module for installation on the countertop of claim 5, further comprising a reset device arranged between the upper connector and the lower connector.

7. The installation module for installation on the countertop of claim 6, wherein the fixing seat comprises a body, an arc matching the mounting hole and arranged at a lower end of the body, a flange configured to be supported on the countertop and arranged on the body above the arc, a hole in a middle of the body, a connecting ring securely connected to the body and arranged in the hole, and a third through hole in the connecting ring with the screw rod inserted therein.

8. The installation module for installation on the countertop of claim 7, further comprising a connecting piece matching a side wall of the body and arranged on the connecting ring, a first connecting through hole in the connecting piece, and a second connecting through hole matching the first connecting through hole and formed in the side wall of the body.

* * * * *